US006489929B1

(12) United States Patent
Duchesne et al.

(10) Patent No.: US 6,489,929 B1
(45) Date of Patent: Dec. 3, 2002

(54) CENTRALLY FED ANTENNA SYSTEM AND METHOD FOR OPTIMIZING SUCH AN ANTENNA SYSTEM

(75) Inventors: Luc Duchesne, Orsonville (FR); Helmut Wolf, Holzkirchen; Norbert Nathrath, Taufkirchen, both of (DE)

(73) Assignee: Astrium GmbH, Munich (DE)

( * ) Notice: Subject to any disclaimer, the term of this patent is extended or adjusted under 35 U.S.C. 154(b) by 0 days.

(21) Appl. No.: 09/673,838

(22) PCT Filed: Apr. 20, 1999

(86) PCT No.: PCT/DE99/01188

§ 371 (c)(1),
(2), (4) Date: Mar. 9, 2001

(87) PCT Pub. No.: WO99/54955

PCT Pub. Date: Oct. 28, 1999

(30) Foreign Application Priority Data

Apr. 21, 1998 (DE) ..... 198 17 766

(51) Int. Cl.[7] ..... H01Q 19/20
(52) U.S. Cl. ..... 343/781 P; 343/914
(58) Field of Search ..... 343/914, 840, 343/781 R, 781 P, 781 CA, 912; H01Q 19/20

(56) References Cited

U.S. PATENT DOCUMENTS 4,307,403 A 12/1981 Yamada et al. ..... 343/755

OTHER PUBLICATIONS

"VDE Software in der Antennentechnik", Mar. 13, 1994.
Beez et al., "Grundlegende Entwurfsaspekte und elektrische Messungen einer Satellitenantenne mit spziell geformter Oberfläche", pp. 59–64 (1994).
Dijk J and Maanders E. J., "Optimising the blocking efficiency in shaped cassegrain systems" Electronics Letters, Bd. 4, No. 18, Sep. 6, 1968 pp. 372–373, XP002118526, London, UK.
Sorensen S.B.: "Manual for POS", Feb. 1991, TICRA Engineering Consultants, Copenhagen, Denmark, XP002118529, pp. 1–1—2–7.
Duchesne L. et al: "Center fed single reflector contoured beam antenna with dual linear polarization", Antennen, 21—24, Apr. 1998, pp. 11–16, XP002118527, Munchen, Germany.
Cleveland J.R. et al: "Light–weight transportable 2.4–meter tri–band antenna system for commercial and military satellites" Milcom 97 Proceedings, B. 1, Sep. 2–5, 1997, pp. 256–260, XP002118528, Monterey, USA.
Duan D W Et al: "Diffraction Synthesis of Dual–reflector Antennas Considering Array Feed Blockage, and Near–Field Effect" Proceedings of the Antennas and Propagation Society International Symposium (APSIS), Chicago, Jul. 20–24, 1992, Bd. 1, Jul. 20, 1992, pp. 355–358, XP000319140, Institute of Electrical and Electronics Engineers ISBN: 0–7803–0730–5.
"Systematic approach to control feed scattering and multiple reflections in symmetrical primary–fed reflector antennas", IEE Proceedings–H, vol. 139, No. 1, Feb. 1992, pp. 65–71.
"A Generalized Diffraction Synthesis Technique for High Performance Reflector Antennas", Dah–Weih Duan, Member, IEEE, and Yahya Rahmat–Samii, Fellow, IEEE, IEEE Transactions on Antennas and Propagation, vol. 43, No. 1, Jan. 1995, pp. 27–40.
"Some recent advances in microwave reflector antennas", Proceedings of the Institute of Electrical Engineers, Electronics, vol. 126, No. 1, Jan. 1979, pp. 9–25.

*Primary Examiner*—Michael C. Wimer
(74) *Attorney, Agent, or Firm*—Crowell & Moring LLP

(57) ABSTRACT

A centrally fed reflector antenna system has an effective reflector surface shaped so that the maximum of the copolar far field lies on the illuminated coverage area corresponding to the far field requirements, and the minimum of the copolar near field lies at the feed system, e.g. at the aperture of a feed horn.

18 Claims, 3 Drawing Sheets

CENTRALLY FED ANTENNA SYSTEM AND METHOD FOR OPTIMIZING SUCH AN ANTENNA SYSTEM

Figure 1:
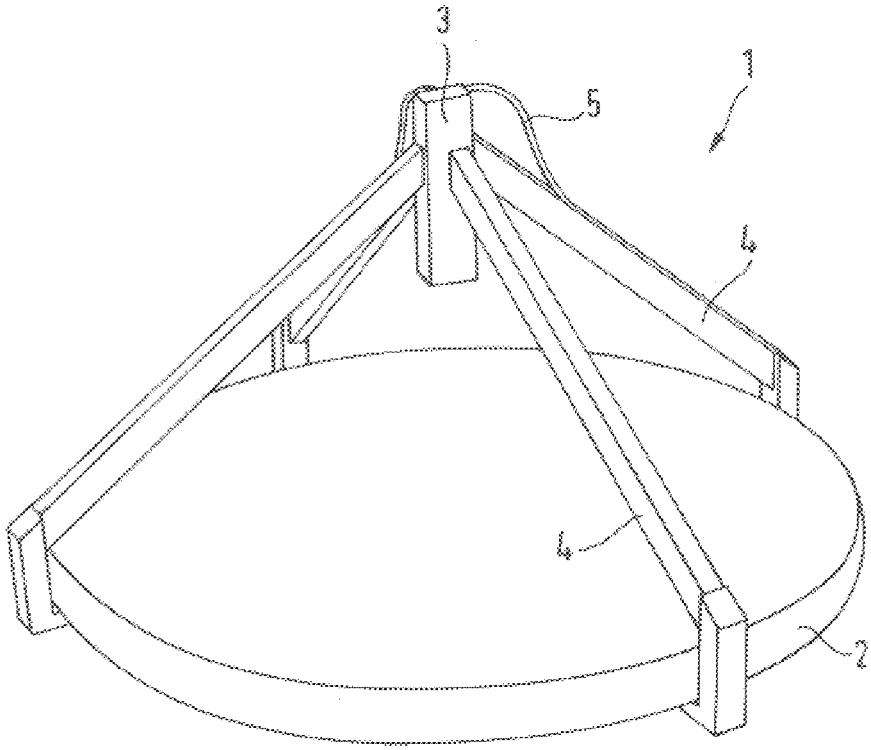

The invention concerns a centrally fed antenna system and a process to optimize it.

Centrally fed antenna systems usually have a single reflector and a feed system, although double reflector systems are known where the feed system irradiates a subreflector that itself irradiates a main reflector. In the following, only a single reflector antenna system will be discussed; however, the designs can also be used for double reflectors.

In comparison to antennas with a single reflector and offset feed system, centrally fed antenna systems with a single reflector are more compact. In regard to the electromagnetic properties, a centrally-fed antenna does not have offset cross-polarization and hence generates less cross-polarization than an antenna system with a single reflector and an offset feed system. However, centrally-fed antenna systems have two substantial disadvantages in regard to electromagnetic properties: First, the electromagnetic field sent by the reflector is shaded by the feed system, the supports for the feed system, and the feed cable; second, this electromagnetic field affects the feed system. The shading basically influences the copolar polar antenna pattern. It produces a ripple in the pattern in the main beam direction and changes the level of the side lobes. Additional cross-polarization arises for circular polarized, centrally fed antennas. The effect on the feed system from the near field reflected by the reflector basically influences the cross-polarized antenna pattern and the reflection factor of the overall system.

The shading can be reduced by making the parts of the antenna system in the near field (that is, the supports, feed system and cable) as transparent as possible for the electromagnetic field. In addition, electrically conductive sheathing can reduce additional scatter in the near field and hence noise in the far field.

Dispersion or scatter bodies such as small cones that are placed in the centre of the reflector can reduce the effect of the near field on the feed system. The scatter bodies are shaped so that the stray field that proceeds from them and the near field reflected by the reflector destructively overlap at the feed system so that a zero area is generated at this location. This stray field of course also influences the far field as well.

The invention is based on the problem of modifying a centrally fed antenna system so that the effect of the shading and the reaction of the feed system are clearly reduced. In addition, a procedure will be presented to attain this.

The features of patent claim 1 solve these problems regarding a centrally fed antenna system. In regard to the procedure, these problems are solved by the features of the additional independent patent claims.

Basically, the entire effective reflector surface is shaped so that the maximum of the copolar far field lies on the irradiated coverage area corresponding to the requirements of the far field, and the minimum of the copolar near field lies at the feed system, e.g. at the aperture of a horn.

The actual shape of the effective surface of the reflector system is determined on a computer with a software program. First the surface of the reflector is calculated using a program according to the requirements of the copolar far field. The influences of the effect between the reflector surface and feed system can be initially ignored. There exists such a prior-art program and is generally termed a PO program, i.e., physical optics (see for example Stig Busk Sorensen: *Manual for POS, Physical Optics Single Reflector Shaping Program;* TICRA Engineering Consultants, Copenhagen, Denmark, June, 1995). A computer model of an antenna system adapted to the requirements of the copolar far field is obtained.

This computer model is then optimized with an optimization program that is used basically for the entire effective reflector surface so that the effects of the near field on the feed system are essentially reduced to nothing without basically changing the properties of the copolar far field.

Such a procedure that optimizes the entire effective antenna surface substantially improves the reflection factor of the entire system and the copolarization and cross-polarization properties.

Figure 2:
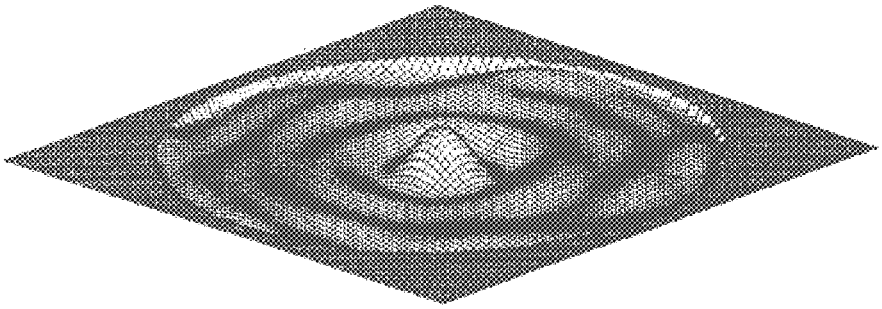
Figure 3:
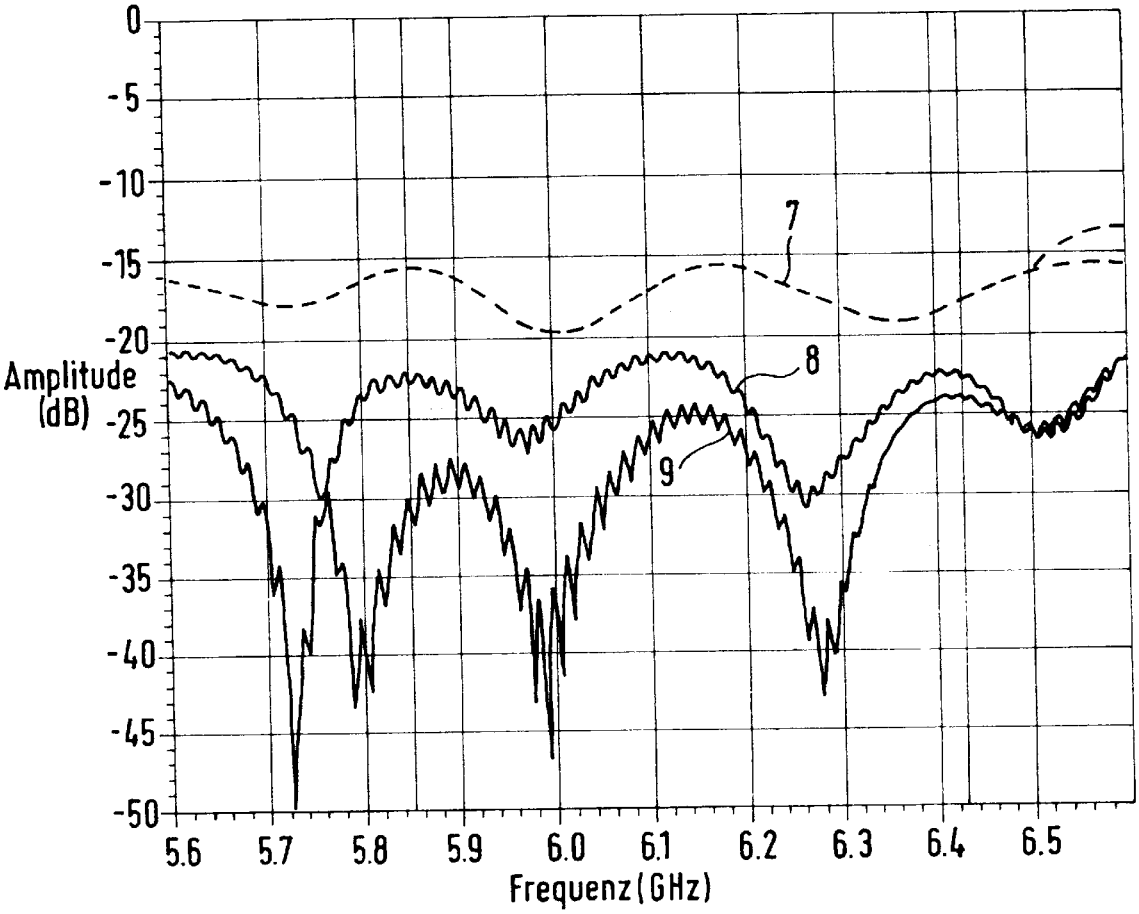

The invention will be further explained using an exemplary embodiment with reference to the drawing. Shown are:

FIG. 1 a schematic perspective view of a centrally fed antenna with a horn as the feed system and a single reflector whose surface is shaped according to the invention;

FIG. 2 a schematic perspective view of the deviation of the surface shape of the reflector shaped according to the invention from a conventional parabolic reflector;

FIG. 3 a representation of the reflection factor of the overall system for a reference system with a parabolic reflector for the polarization in the X direction and for an antenna system according to the invention for the polarization in the X and Y directions;

FIGS. 4*a*–4*d* comparisons of the antenna patterns in the elevation and azimuth above the coverage area in copolarization and cross-polarization for a reference system and an antenna system according to the invention.

FIG. 1 shows a centrally fed antenna system 1 with a single reflector 2 and a feed system (a horn 3 in this case), where the horn is held by four supports 4 in the middle above the reflector 2 and is fed by a cable 5.

The reflector 2 is a parabolic reflector that is designed according to conventional methods so that a desired coverage area (FIG. 4) is sufficiently illuminated. The antenna system 1 is e.g. used on a communications satellite so that the coverage area is a specific area on the earth's surface.

To reduce the attenuation of the far field by the horn, the supports and cable, the supports 4 are designed as braces with a honeycomb structure made of fiber-reinforced plastic. Aramide fibers are preferably used. The horn 3 is generally covered with a reflective foil (such as aluminium foil) which in particular serves to prevent reflections of the near field on sharp edges, etc.

The surface of the parabolic reflector is first calculated with a software program so that the far field of the antenna system will cover the desired coverage area. This is done e.g. with the above-cited PO program.

Finally, a computer-supported optimization process is carried out using an optimization program that essentially optimizes the entire reflective surface point for point to optimize the requirements for the near field and those in the far field. The requirements for the near field are essentially that the surface be shaped so that a zero area arises at the aperture of the horn in the copolar near field, and a maximum is generated on the coverage area in the copolar far field.

FIG. 2 contrasts the attained deviations of the optimized reflector surface with the preshaped reflector surface. The data concern an antenna reflector with a diameter of 100 cm and a spacing of the horn aperture above the centre of the parabolic reflector of 40 cm. The frequency band for this antenna is 5.8 to 6.4 GHz with dual linear polarization. The deviations in FIG. 2 of the optimized reflector 2 from the preshaped parabolic shape are between −1.74 mm and +4.41 mm.

FIG. 3 shows the reflection factor of the overall system in comparison to the reference system with a preshaped parabolic reflector in a frequency band of 5.6 to 6.5 GHz. 7 indicates the curve of the reference system in copolarization; 8 is the corresponding curve for the optimized antenna system according to FIGS. 1 and 2. One can see that the values are clearly improved. 9 shows the cross-polarization curve for the antenna system according to the invention. The average amplitude for the overall system is approximately 22 dB.

FIG. 4 shows antenna patterns over the coverage area for the reference system with a parabolic reflector, and for the antenna system according to the invention. FIGS. 4*a* and 4*b* show the copolar antenna patterns for the reference system and the system according to the invention. The lines are given the respective dB values. In the reference system in FIG. 4*a*, one can see an area 10 in the middle of the coverage area delimited by a line and is assigned 24 dB. Such an area does not exist in FIG. 4*b* in the antenna system according to the invention. The overall coverage system of the antenna system according to the invention is approximately delimited by an area of 24 dB. By optimizing the entire surface of the antenna reflector according to the invention, the copolar far field can be given a better design. The disturbance in the copolar field due to the loss from the horn, braces and the cable is greatly reduced by the antenna system according to the invention.

Figure 4A:
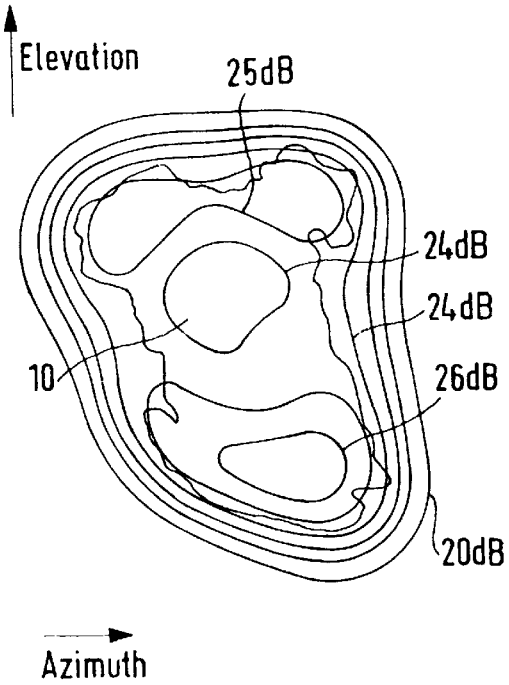
Figure 4C:
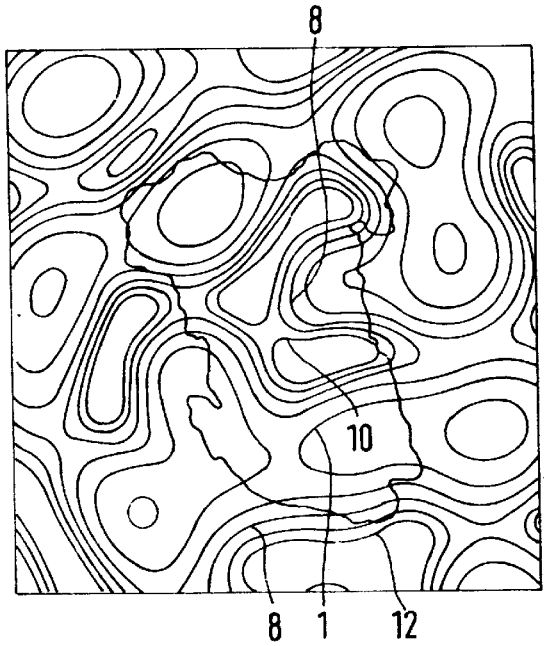
Figure 4B:
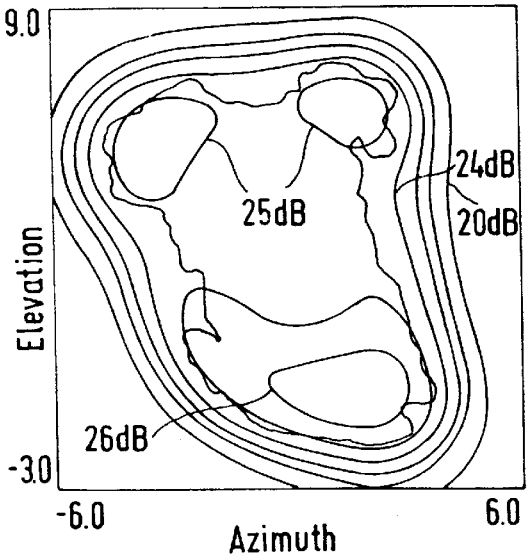
Figure 4D:
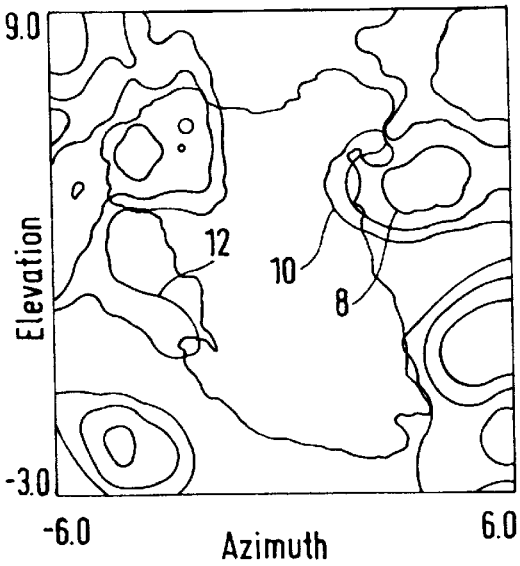

FIG. 4*c* shows the cross-polarization antenna pattern of the reference system. FIG. 4*d* shows the pattern of the antenna system according to the invention. One can clearly see that the properties of the antenna are substantially improved, i.e., the optimization of the overall reflector surface reduces the influence of the near field on the feed system.

The overall system is generally improved enough that the disturbance from the attenuation and subsequent effect on the feed system are approximately that of an equivalent interfering transmitter of more than −30 dB.

The table at the conclusion of the description shows the values for the maximum overall reflection factor, the minimum gain at the edge of the illuminated coverage area, the minimum gain in the coverage are in a frequency band of 5.854 to 6.298 GHz, the maximum cross-polarization in the overall coverage area and the minimum cross-polarization discrimination XPD, i.e., a point-for-point correlation between the copolarization and cross-polarization in the entire illuminated coverage area also in a frequency band of 5.854 to 6.298. This is for a parabolic antenna serving as a reference, a parabolic antenna with a central scattering body, and an antenna system whose entire reflector surface was reshaped according to the invention.

One can see that the antenna cross-polarization properties from the effect of the near field on the feed system can be improved more by reshaping the overall reflector surface than by using scattering bodies. The antenna copolarization properties at the edge of the coverage area are better with an optimized reflector surface according to the invention than when scattering bodies are used. The scatter bodies disturb the entire field that was originally designed for the requirements of copolarization. In contrast, the reshaped surface of the reflector according to the invention is an optimum compromise between the copolar antenna properties and the reduction of the effect on the feed system.

Overall, the reformation of the reflector surface yields better electrical properties than the use of scattering bodies.

Although the above antenna system is optimized with a single reflector, of course antenna systems with double reflectors can be optimized as well, i.e., a subreflector and a main reflector according to the invention. The subreflector illuminated by the feed system is optimized over its entire surface to minimize the effect on the feed system and optimally illuminate the main reflector. Then the main reflector is optimized so that the maximum of the copolarization on the coverage area is maximized, and the effect on the subreflector is minimized.

In all the procedures according to the invention, the optimization corresponds well with the initial analysis, i.e., the measured properties of the antenna system correspond very well with the calculated properties. The procedure offers a highly effective tool for constructing antenna systems without complicated and exhaustive experiments.

TABLE

| | Original reflector surface without scatter bodies | | Original reflector surface with plate 90 mm in dia. Pos. 356.4 | | Reshaped reflector surface | |
|---|---|---|---|---|---|---|
| | Pol. X | Pol. Y | Pol. X | Pol. Y | Pol. X | Pol. Y |
| Measurement: maximum overall reflection factor between 5.850 and 6.425 GHz | | −15.0 dB | | −22.0 dB | −21.2 dB | −23.9 dB |
| Measurement: minimum gain at the edge of the illumination area between 5.854 and 6.298 GHz (without cable losses) | 23.11 dBi | 23.69 dBi | 22.95 dBi | 23.10 dBi | 23.86 dBi | 23.73 dBi |
| Measurement: minimum gain within the illumination area between 5.854 and 6.928 GHz (without cable losses) | 23.17 dBi | 23.58 dBi | 23.00 dBi | 23.09 dBi | 23.96 dBi | 23.85 dBi |
| Measurement: maximum cross-polarization on the overall illumination area between 5.854 and 6.298 GHz (without cable losses) | +3.64 dBi | +4.76 dBi | −1.11 dBi | −0.29 dBi | −4.37 dBi | −5.32 dBi |
| Measurement: maximum XPD on the overall illumination area between 5.854 and 6.298 GHz (without cable losses) | 21.87 dB | 19.90 dB | 26.06 dB | 24.80 dB | 29.44 dB | 29.82 dB |

What is claimed is:

1. An antenna system comprising:

a feed system; and a reflector system illuminating a coverage area which reflector system has at least one parabolic reflector with a structured surface; wherein a reflector surface of the parabolic reflector has peaks and valleys that are disposed alternately in a radial direction, and that are at least partially overlapped in a peripheral direction with other peaks and valleys; and the entire structure of the reflector surface has peaks and valleys, with a maximum of a copolar far field lying on the coverage area, and a minimum of a copolar near field lying at the feed system.

2. The antenna system according to claim 1, wherein the reflector surface is shaped so that the copolar far field is substantially unchanged when the near field is optimized to reduce the effect on the feed system.

3. The antenna system according to claim 1, wherein the feed system comprises a horn with a small aperture diameter.

4. The antenna system according to claim 1, wherein the feed system has supporting braces that have a honeycomb structure of fiber-reinforced material.

5. The antenna system according to claim 1, wherein:

the reflector system comprises a main reflector and a subreflector; and surfaces of the main reflector and the subreflector have peaks and valleys.

6. A process for providing an optimized centrally-fed antenna system having a feed system and a reflector system with at least one reflector illuminating a coverage surface, said process comprising:

determining a parabolic surface for at least one reflector;

calculating a far field of the antenna system with a first computer program; and pre-shaping substantially the entire reflector surface of the at least one reflector with a second computer program to form at least partially peripherally extending peaks and valleys disposed sequentially in a radial direction, such that a minimum of a copolar near field is generated in the area of the feed system, and a maximum of the copolar far field lies on the coverage surface.

7. A procedure according to claim 6, having a main reflector and a subreflector, wherein the subreflector surface is first optimized, and then the main reflector surface of the reflector system is optimized.

8. An antenna system comprising:

a feed system; and a reflector system illuminating a coverage area, which reflector system has at least one substantially parabolic reflector with a structured surface; wherein a reflector surface of the substantially parabolic reflector has at least partially peripherally extending peaks and valleys that are disposed sequentially in a radial direction, and that are at least partially overlapped in a peripheral direction with other peaks and valleys; and substantially the entire structure of the reflector surface has peaks and valleys, such that a maximum of a copolar far field lies on the coverage area, and a minimum of a copolar near field lies at the feed system.

9. An antenna system comprising:

a signal feed element; and a reflector element disposed to reflect signals from the signal feed element, reflected signals from the reflector element illuminating a coverage area;

wherein the reflector element has a reflecting surface that has a substantially parabolic contour, and includes deviations from said parabolic contour, which deviations form a pattern of peaks and valleys in said reflecting surface such that a minimum of a copolar near field generated by said antenna system lies in substantial proximity to said signal feed element.

10. An antenna system according to claim 9, wherein said pattern of peaks and valleys is such that a maximum of a copolar far field generated by said antenna system lies substantially on the coverage area.

11. The antenna system according to claim 9, wherein a longitudinal direction of said pattern of peaks and valleys extends substantially circumferentially about a central axis of said reflecting surface.

12. The antenna system according to claim 10, wherein a longitudinal direction of said pattern of peaks and valleys extends substantially circumferentially about a central axis of said reflecting surface.

13. The antenna system according to claim 9, wherein said pattern of peaks and valleys is such that a radial cross section of said reflecting surface contains a series of sequential positive and negative variations.

14. The antenna system according to claim 10, wherein said pattern of peaks and valleys is such that a radial cross section of said reflecting surface contains a series of sequential positive and negative variations.

15. The antenna system according to claim 9, wherein said pattern of peaks and valleys includes a plurality of at least partially circumferentially extending peaks which alternate with at least partially circumferentially extending valleys.

16. The antenna system according to claim 10, wherein said pattern of peaks and valleys includes a plurality of at least partially circumferentially extending peaks which alternate with at least partially circumferentially extending valleys.

17. The antenna system of claim 9, wherein said signal feed element comprises a centrally disposed signal feed element.

18. The antenna system of claim 10, wherein said signal feed element comprises a centrally disposed signal feed element.

* * * * *